US005251336A

United States Patent [19]

Nevins

[11] Patent Number: 5,251,336

[45] Date of Patent: Oct. 12, 1993

[54] HEAD PROTECTOR FOR INCLEMENT WEATHER

[76] Inventor: Michael A. Nevins, 14257 Half Moon Bay Dr., Del Mar, Calif. 92014

[21] Appl. No.: 843,406

[22] Filed: Feb. 28, 1992

[51] Int. Cl.[5] ..... A42B 1/04

[52] U.S. Cl. ..... 2/202; 2/84; 2/173; 2/203; 2/205; 2/206

[58] Field of Search ..... 2/9, 172, 173, 202, 2/203, 205, 206, 84, 410, 424

[56] References Cited

U.S. PATENT DOCUMENTS

| | | | |
|---|---|---|---|
| 781,044 | 1/1905 | Altman | 2/206 |
| 1,592,562 | 7/1926 | Graham | 2/84 |
| 2,344,811 | 3/1944 | Gill | 2/173 |
| 2,448,021 | 8/1948 | De Grazia | 2/205 |
| 2,547,931 | 4/1951 | De Grazia | 2/84 |
| 2,686,317 | 8/1954 | Michaelis | 2/205 |
| 2,839,757 | 6/1958 | Gianola | 2/84 |
| 2,870,452 | 1/1959 | De Grazia | 2/84 |
| 3,943,575 | 3/1976 | Bolker | 2/205 |
| 4,180,868 | 1/1980 | Snow | 2/203 |
| 4,422,184 | 12/1983 | Myers | 2/84 |
| 4,768,235 | 9/1988 | Webster | 2/205 |

FOREIGN PATENT DOCUMENTS

| | | | |
|---|---|---|---|
| 2306648 | 11/1976 | France | 2/202 |
| 117209 | 7/1969 | Norway | 2/173 |

*Primary Examiner*—Clifford D. Crowder
*Assistant Examiner*—Diana L. Biefeld
*Attorney, Agent, or Firm*—Nydegger & Associates

[57] ABSTRACT

A head protector for inclement weather includes a hood having a facial port and a neck portion surrounding a neck channel. A dickey is attached to the outside of the hood at the neck portion to also surround the neck channel, and a collar is attached to the outside of the neck portion between the hood and the dickey. A face shield having a mesh panel is attached to the hood across the facial port to cover the nose and mouth of the user. Also included is a flap which is releasably attachable to the hood to cover the face shield. A drawstring is attached to the outer periphery of the collar for cinching the collar around the neck of the user.

14 Claims, 1 Drawing Sheet

HEAD PROTECTOR FOR INCLEMENT WEATHER

FIELD OF THE INVENTION

The present invention pertains generally to inclement weather gear. More particularly, the present invention pertains to inclement weather gear for protecting the head of a user from the elements. The present invention is particularly, but not exclusively, useful as protective head gear for use when skiing.

BACKGROUND OF THE INVENTION

Many manufactured devices respond to the primal need to protect heads from inclement weather. Products range from simple, selectively protective devices like ear muffs and stocking caps, to cowls and hoods permanently attached to outdoor gear like parkas. While the simple devices may be light and allow a free range of motion, they do not protect the head and neck during severely inclement weather. Such simple protectors also leave gaps exposed between the device and other clothing. Head protectors which are directly attached to outer garments like parkas can inhibit free motion and restrict visibility. They also may preclude air circulation through the hood and obstruct breathing. This can make the use of glasses and goggles during work or sport difficult.

In light of the above, an object of the present invention is to provide a head protector which, while being a portable component which can be integrated with other inclement weather clothing, forms a warm, protective, closed seal at the juncture between the head protector and, for example, a ski parka in the area of the neck and upper torso of the user. Yet another object is to provide a head protector with a facial port which allows both a wide range of visibility and protection of the nose and lower face from inclement weather. It is yet another object to provide an inclement weather head protector which is relatively simple to use, is easy to manufacture, and is comparatively cost effective.

SUMMARY OF THE INVENTION

A head protector for inclement weather according to the present invention includes a hood having an outside and an inside surface. The hood is formed with a facial port and has a neck portion which defines a neck channel. A user can insert his/her head through this neck channel to bring his/her head into contact with the inside surface of the hood. When the user's head has been inserted into the hood, the user's face is exposed through the facial port.

A substantially circular shaped dickey is formed with a hole, and the hole is defined by an edge of the dickey. The edge is attached to the hood, at its neck portion, to align the hole in the dickey with the neck channel, and to position the dickey around the neck channel. Additionally, the head protector of the present invention includes an annular shaped collar which has an outer periphery and an inner periphery. The inner periphery of this collar is attached to the outside surface of the hood at the neck portion to position the collar between the dickey and the hood.

The head protector also includes a face shield which is attached to the hood across a portion of the facial port to cover and protect the mouth and nose of the user. A mesh panel can be included as part of the face shield to facilitate breathing by the user.

A substantially rectangular flap is attached to the hood to selectively cover or uncover the face shield according to the desires of the user. As so attached, the lower edge of the flap is connected to the hood below the facial port, and the side edges of the flap are provided with fasteners which are releasably connectable to the hood along the side edges of the face shield. For an alternate embodiment of the present invention, one side edge of the flap, in addition to its lower edge, can be fixedly attached to the hood. The other side edge, which is unattached, can still be provided with fasteners for the purpose indicated above. According to the present invention, the fasteners can be either velcro fasteners, zippers or snaps.

A visor can be attached to the hood to extend outwardly from the hood above the facial port. This visor can be used to provide shade for the eyes of the user. Further, a draw string can be positioned along the outer periphery of the collar so that the collar can be cinched around the neck of the user to provide additional protection for the user. As intended for the present invention, the hood is made of a nylon shell which has a permeable lining; the dickey and the flap are made of the same nylon material and have fleece linings; and the collar is made of the nylon material.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENTS

Figure 1:
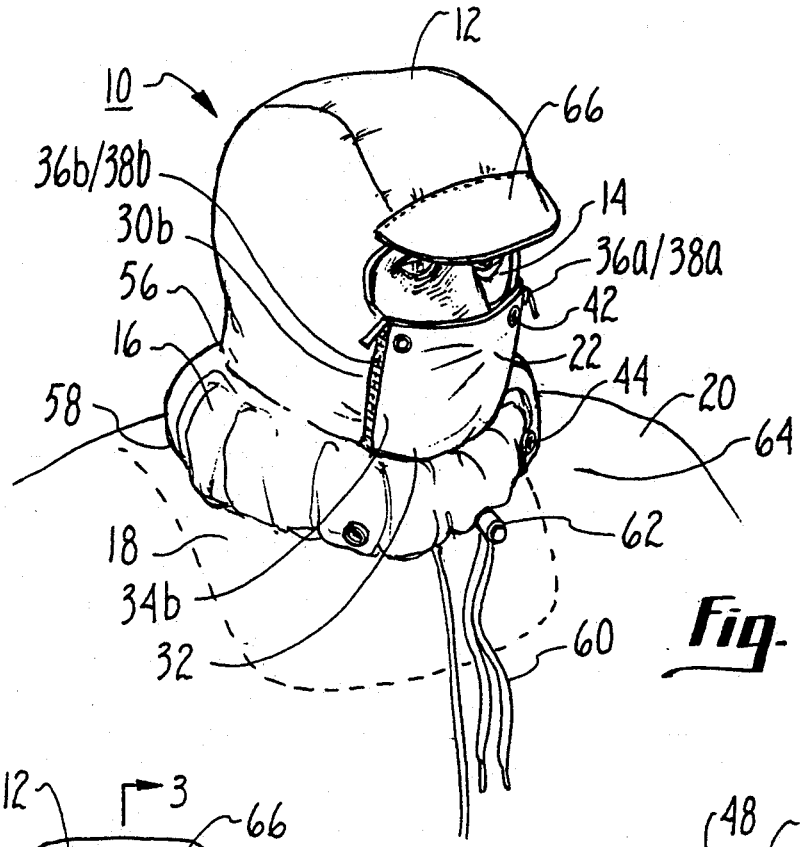
FIG. 1 is a perspective view of the head protector for inclement weather of the present invention shown being worn by a user with the flap closed.

Referring initially to FIG. 1, the inclement weather head protector of the present invention is shown and generally designated 10. As shown, head protector 10 includes a hood 12 which is formed with a facial port 14. Additionally, the head protector 10 has a collar 16 and a dickey 18 (shown in phantom in FIG. 1). As intended for the present invention, when head protector 10 is worn by a user 20, the head of user 20 is covered by hood 12 to expose the face of user 20 through facial port 14. At the same time, dickey 18 covers portions of the upper body of user 20 around his/her neck area.

Figure 2:
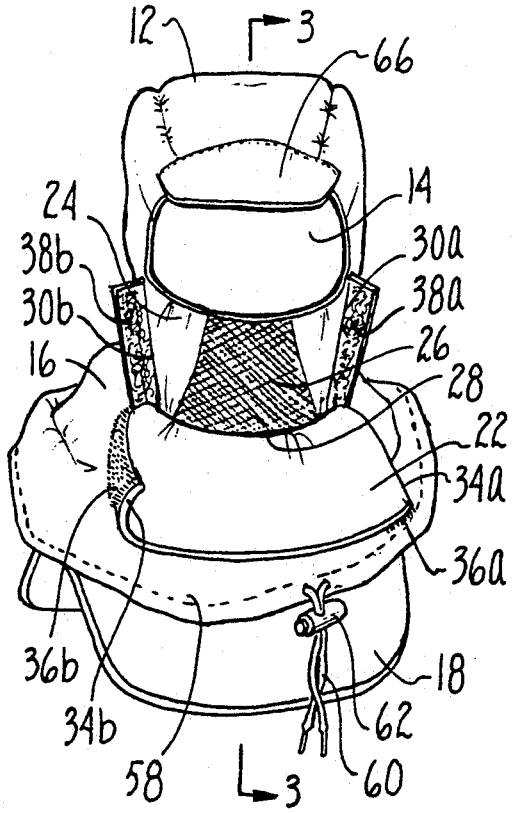
FIG. 2 is a perspective view of the head protector for inclement weather with the flap open.

Protector 10 also includes a flap 22 which, as shown in FIG. 1, can be selectively positioned to cover the mouth and nose of user 20. FIG. 2 shows that flap 22 can be partially detached from hood 12 to provide added exposure for the of user 20 as desired. FIG. 2 also shows that a face shield 24 extends across the lower portion of facial port 14, and that a mesh panel 26 can be included as part of the face shield 24. The mesh panel 26 facilitates breathing by user 20. For purposes of the present invention, mesh panel 26 can be made of any material well known in the pertinent art which will not inhibit air flow. Preferably, mesh panel 26 is sufficiently flexible to allow user 20 to pull the face shield 24 under his/her chin.

As best seen in FIG. 2, the substantially rectangular shaped face shield 24 has a lower edge 28 and a pair of opposed side edges 30*a* and 30*b*. Also, the substantially rectangular shaped flap 22 has a lower edge 32 and a pair of opposed side edges 34*a* and 34*b*. As shown, the lower edge 32 of flap 22 is attached to hood 12 along the lower edge 28 of face shield 24. Furthermore, fasteners 36*a* and 36*b* extend respectively along side edges 34*a* and 34*b* of flap 22, while mating fasteners 38*a* and 38*b* extend respectively along side edges 30*a* and 30*b* of face shield 24. As indicated in FIG. 1, the fasteners 36*a* and 36*b* on flap 22 are respectively attachable to the fasteners 38*a* and 38*b* on hood 12 to hold flap 22 in a position to cover the nose and mouth of user 20. In contemplation of the present invention, fasteners 36/38 can be of any type well known in the pertinent art, such as the Velcro type fasteners 36/38 shown in FIG. 2 or the zipper shown in FIG. 1. Also, the fasteners 36/38 may be snaps, such as snap 40 shown in FIG. 3. Further, as best seen in FIG. 1, a snap 42 on flap 22 can be engaged with a snap 44 on collar 16 to secure and hold the flap 22 in a position as shown in FIG. 2.

Figure 3:
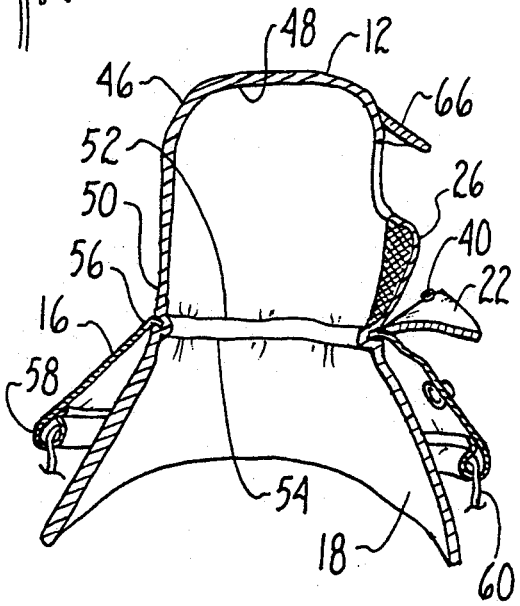
FIG. 3 is a cross-sectional view of the head protector for inclement weather as seen along the line 3—3 in FIG. 2.

The actual construction of the inclement weather head protector 10 of the present invention will, perhaps, be best appreciated with reference to FIG. 3. There it will be seen that hood 12 has an outside surface 46 and an inside surface 48. Also, it can be seen that a neck portion 50 of hood 12 establishes a neck channel 52 through which the user 20 is able to insert his/her head into the hood 12. Further, FIG. 3 shows that an edge 54 of an effectively annular shaped dickey 18 is attached to the neck portion 50 of hood 12 substantially as shown. Also, the collar 16 is attached to the outside surface 46 of hood 12 at its neck portion 50. Specifically, an inner periphery 56 of annular shaped collar 16 is attached to hood 12. An outer periphery 58 of the collar 16 is provided with a drawstring 60 which can be cinched to gather the collar 16 around the neck of the user 20. A cinch clip 62 is slidably attached to the drawstring 60 to hold it and collar 16 in a cinched configuration when desired by the user 20. Preferably, protector 10 is made of a nylon shell with a permeable lining. Both the nylon shell and the lining can be of any type well known in the pertinent art.

In use, the user 20 inserts his/her head through neck channel 52 to position his/her head in the hood 12 with his/her face exposed through face port 14. Thus, the head of user 20 is placed into contact with the inside surface 48 of hood 12. This also causes dickey 18 to cover the upper body portion of user 20 in the area of his/her neck. User 20 then puts on his/her ski parka 64 and brings the collar of ski parka 64 up and over dickey 18. Drawstring 60 can then be adjusted, as desired, to bring collar 16 of head protector 10 into an entwined cinched configuration with ski parka 64 to provide wind and moisture resistant protection for user 20 in his/her neck area. Partial protection against the sun can be achieved by providing head protector 10 with a visor 66. Such a visor 66 can be attached to hood 12 to extend outwardly therefrom substantially as shown in FIGS. 2 and 3. Additionally, goggles (not shown) may be used by user 20 for eye protection. Still additional protection can be provided for user 20 by moving flap 22 from an uncovered configuration, as shown in FIG. 2, to a covered configuration, as shown in FIG. 1. This is accomplished by manipulation of the fasteners 36/38 as indicated above.

While the particular inclement weather head protector as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. An inclement weather head protector for wear by a user which comprises:

a hood having an outside surface and an inside surface and formed with a facial port, said hood having a neck portion surrounding a neck channel to allow insertion of the head of a user through said neck channel and into contact with said inside surface of said hood to expose the face of the user through said facial port;

a dickey having an edge defining a hole through said dickey, said edge being attached to said neck portion of said hood to place said dickey in a surrounding relationship with said neck channel;

an integral collar having an outer periphery and an opening defined by an inner periphery, said inner periphery being attached to said outside surface of said hood at said neck portion of said hood to position said collar between said dickey and said facial port of said hood;

a face shield attached to said hood across a portion of said facial port to cover the nose and mouth of the user, said face shield including a mesh panel to facilitate breathing by the user, wherein said face shield is substantially rectangular and has an upper edge, a lower edge, and a pair of opposed side edge with said lower edge and said side edges being attached to said hood, and said hood further comprising:

a substantially rectangular flap having an upper edge, a lower edge and a pair of opposed side edges, said lower edge of said flap being fixedly attached to said neck portion of said hood adjacent said lower edge of said face shield; and a plurality of fasteners, individual said fasteners being attached along each said side edge of said flap and along each said side edge of said face shield to releasably hold said flap across said face shield.

2. An inclement weather head protector as recited in claim 1 wherein said fasteners are snaps.

3. An inclement weather head protector as recited in claim 1 wherein said fasteners are hook and loop fasteners.

4. An inclement weather head protector as recited in claim 1 wherein said fasteners are zippers.

5. An inclement weather head protector as recited in claim 1 wherein said face shield is substantially rectangular and has an upper edge, a lower edge, and a pair of opposed side edges with said lower edge and said side edges being attached to said hood, and said hood further comprises:

a substantially rectangular flap having an upper edge, a lower edge and a first side edge opposite a second side edge, said lower edge of said flap being fixedly attached to said neck portion of said hood adjacent said lower edge of said face shield and said first side edge of said flap being fixedly attached to one said side edge of said face shield; and a plurality of fasteners, individual said fasteners being attached along said second side edge of said flap and along said corresponding side edge of said face shield to releasably hold said flap across said face shield.

6. An inclement weather head protector as recited in claim 1 wherein said collar is substantially circular.

7. An inclement weather head protector as recited in claim 1 further comprising a draw string positioned along said outer periphery of said collar for cinching said collar around the neck of the user.

8. An inclement weather head protector, as recited in claim 1, further comprising a visor attached to said hood to extend outwardly from said hood adjacent said facial port opposite said face shield.

9. An inclement weather head protector for wear by a user which comprises:

means for covering the head of the user to leave the face of the user exposed;

means attached to said head covering means for selectively covering the mouth of the user;

means attached to said head covering means and extending therefrom for covering upper body portions of the user;

means attached to said head covering means for cinching said head protector around the neck of the user;

wherein said head covering means is a hood having an outside surface and an inside surface and formed with a facial port, said hood having a neck portion surrounding a neck channel to allow insertion of the head of a user through said neck channel and into contact with said inside surface of said hood to expose the face of the user through said facial port; and wherein said mouth covering means comprises: a face shield attached to said hood across a portion of said facial port to cover the nose and mouth of the user, said face shield having a mesh panel to facilitate breathing by the user, and wherein said face shield is substantially rectangular and has an upper edge, a lower edge, and a pair of opposed side edges with said lower edge and said side edges being attached to said hood;

a substantially rectangular flap having an upper edge, a lower edge and a pair of opposed side edges, said lower edge of said flap being fixedly attached to said neck portion of said hood adjacent said lower edge of said face shield; and a plurality of fasteners, individual said fasteners being attached along each said side edge of said flap and along each said side edge of said face shield to releasably hold said flap across said face shield.

10. A head protector as recited in claim 9 wherein said upper body covering means is a dickey formed with a hole defined by an edge of said dickey, said edge being attached to said outer surface at said neck portion of said hood to place said dickey in a surrounding relationship with said neck channel.

11. A head protector as recited in claim 10 wherein said cinching means is an integral collar having an outer periphery and an opening defined by an inner periphery, said inner periphery being attached to said outer surface at said neck portion of said hood to position said collar between said dickey and said facial port of said hood.

12. A head protector as recited in claim 11 further comprising a draw string positioned along said outer periphery of said collar for cinching said collar around the neck of the user.

13. A head protector as recited in claim 12 wherein said protector is made of a nylon shell having a permeable fleece lining.

14. A head protector as recited in claim 13 further comprising a visor attached to said hood to extend outwardly therefrom adjacent said facial port opposite said face shield.

* * * * *